US005619892A

United States Patent [19]

Eggert

[11] Patent Number: 5,619,892

[45] Date of Patent: Apr. 15, 1997

[54] OPENING SPRING FOR PIVOTING HAND TOOL

[75] Inventor: Daniel M. Eggert, Kenosha, Wis.

[73] Assignee: Snap-on Technologies, Inc., Crystal Lake, Ill.

[21] Appl. No.: 635,732

[22] Filed: Apr. 22, 1996

Related U.S. Application Data

[63] Continuation of Ser. No. 336,381, Nov. 8, 1994, Pat. No. 5,522,289.

[51] Int. Cl.[6] ..... B25B 7/00

[52] U.S. Cl. ..... 81/417; 24/11 R; 267/158

[58] Field of Search ..... 81/417, 321, 427; 24/511, 11 HC, 3.11, 3.12, 11 R, 11 S, 11 F; D19/56; 267/158, 163–165; 30/261

[56] References Cited

U.S. PATENT DOCUMENTS

| | | |
|---|---|---|
| 38,316 | 4/1963 | McDonald . |
| D. 200,746 | 3/1965 | Han ..... 19/56 |
| D. 324,069 | 2/1992 | Katami . |
| D. 357,278 | 4/1995 | Turney . |
| 870,886 | 11/1907 | Johnson . |
| 945,702 | 1/1910 | Cousino . |
| 1,312,396 | 8/1919 | Harper . |
| 1,453,603 | 5/1923 | Redman . |
| 1,622,316 | 3/1927 | Hanle . |
| 1,756,241 | 4/1930 | Doebler . |
| 1,802,904 | 4/1931 | Bryant . |
| 1,895,656 | 1/1933 | Gadke . |
| 2,004,524 | 6/1935 | Foeckler, Sr. . |
| 2,055,882 | 9/1936 | Rodemeyer . |
| 2,216,886 | 10/1940 | Langelier . |
| 2,219,600 | 10/1940 | Potter . |
| 2,676,404 | 4/1954 | Peckron et al. . |
| 2,751,653 | 6/1956 | Leibow . |
| 3,176,551 | 4/1965 | Hansen . |
| 3,207,546 | 9/1965 | Ernest . |
| 3,261,244 | 7/1966 | Smoyak et al. . |
| 4,400,876 | 8/1983 | Brown . |

FOREIGN PATENT DOCUMENTS

| | | |
|---|---|---|
| 4317232 | 2/1965 | Japan . |

OTHER PUBLICATIONS

Snap–on Incorporated Catalog pp. 194, 196.

*Primary Examiner*—D. S. Meislin
*Attorney, Agent, or Firm*—Emrich & Dithmar

[57] ABSTRACT

A pivoting lever hand tool is provided with an opening spring which clips onto one of the lever handles and resiliently engages the other to bias the handles open. The spring has a flexible and resilient coupling channel which clips onto one handle and includes a plurality of flat panel sections extending end-to-end of the channel. A bias leaf is unitary with one of the panel sections and projects from one end thereof out of the plane thereof to engage the other handle, and terminates at a distal end which engages the one handle. The bias leaf may be provided along all or part of its length with single or double over layers, either laminated or folded over. The bias leaf may extend either away from the coupling channel or back along its length.

2 Claims, 2 Drawing Sheets

OPENING SPRING FOR PIVOTING HAND TOOL

This is a continuation of application Ser. No. 08/336,381, filed Nov. 8, 1994.

BACKGROUND OF THE INVENTION

1. Field of the Invention

The present invention relates to hand tools of the pivoting lever type, and in particular to bias springs for biasing the handles of the levers apart in an opening direction.

2. Description of the Prior Art

It is well known to provide pivoting lever hand tools, such as pliers, cutters and the like, with a bias mechanism to bias the levers apart to an open condition. However, in prior arrangements the bias spring is fixed to one or both of the levers with some sort of attachment. This usually requires some alteration of the construction of the levers to permit connection of the bias spring thereto. Also, the prior arrangements do not permit retrofitting of a spring by a user to a pre-existing tool.

One prior arrangement provides a helical compression spring, seated in holes drilled in the two levers. Another arrangement incorporates a flat spring which is welded to one of the handles and cantilevered to the other handle. Another arrangement utilizes a torsion spring which can either be fixed in place at the pivot junction of the levers by a pivot screw or the like, or may be provided with distal ends which are seated in holes drilled in the handle portions of the levers.

SUMMARY OF THE INVENTION

It is a general object of the invention to provide an improved hand tool and opening spring therefor which avoid the disadvantages of prior hand tools and bias springs while affording additional structural and operating advantages.

An important feature of the invention is the provision of a bias spring which can be mounted on a hand tool without the use of separate attachment structure.

Another feature of the invention is the provision of a bias spring of the type set forth which is of simple and economical construction.

Yet another feature of the invention is the provision of a bias spring which can easily be retrofitted to an existing tool.

A still further feature of the invention is the provision of a hand tool incorporating a bias spring of the type set forth.

Certain ones of these and other features of the invention are attained by providing a hand tool comprising: a pair of levers each having a handle portion, a pivot coupling the levers for pivotal movement toward and away from each other between closed and open conditions, and a flexible and resilient leaf spring having a coupling portion and a bias portion, the coupling portion being shaped and dimensioned to be clipped onto and resiliently grip one of the handle portions in a use position, the bias portion extending from the coupling portion and being curved so that when the coupling portion is in its use position the bias portion engages the other of the handle portions to bias the handle portions apart to their open condition while being yieldable to accommodate movement of the handle portions to their closed condition.

Further features of the invention are attained by providing a clip-on bias spring comprising: a flexible and resilient coupling channel having opposed ends and being generally C-shaped in transverse cross section and having a maximum width, the channel having substantially parallel side edges cooperating to define an opening into the channel and being spaced apart a distance less than the maximum width of the channel, the channel including a plurality of substantially flat panel sections each extending from one end of the channel to the other end thereof and each defining a plane when at rest, and an elongated bias leaf unitary with one of the panel sections and projecting from one end of the channel, the leaf being curved out of the plane of the one panel section and terminating at a distal end portion which is disposed at rest substantially in the plane of the one panel section.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figures 1, 2, 3, 4, 5, 6, 7, 8:
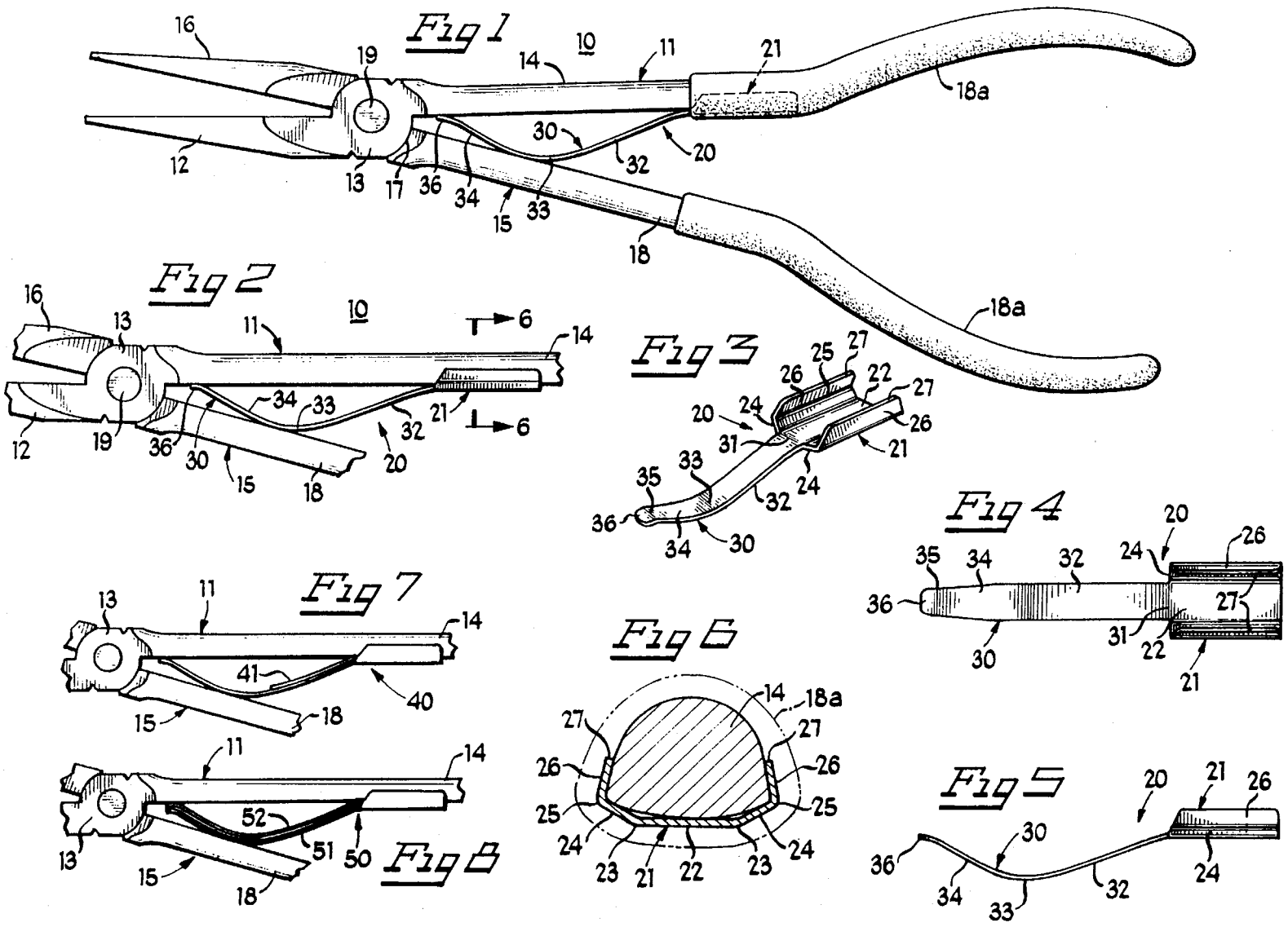
FIG. 1 is a top plan view of a pair of pliers incorporating an opening bias spring in accordance with the present invention, with the pliers shown in their normal open position.
FIG. 2 is a fragmentary view of the portion of FIG. 1 illustrating the clip-on bias spring with the handle grip removed.
FIG. 3 is a perspective view of the clip-on bias spring of FIG. 2.
FIG. 4 is a top plan view of the clip-on bias spring of FIG. 3.
FIG. 5 is a side elevational view of the clip-on bias spring of FIG. 4.
FIG. 6 is an enlarged view in vertical section taken along the line 6—6 in FIG. 2.
FIG. 7 is a reduced, fragmentary view, similar to FIG. 2, illustrating another embodiment of the clip-on bias spring of the present invention.
FIG. 8 is a view similar to FIG. 7 illustrating yet another embodiment of the clip-on bias spring of the present invention.

Referring to FIG. 1, there is illustrated a hand tool, generally designated by the numeral 10, of the crossed, pivoting lever type. While the hand tool 10, as illustrated, is a long-reach, needle-nosed pliers with crossed levers, it will be appreciated that the present invention is applicable to other types of pivoting lever tools. The hand tool 10 includes a lever 11 having an elongated jaw portion 12, a joint portion 13 and an elongated handle portion 14. The hand tool 10 also includes a lever 15 having an elongated jaw portion 16, a joint portion 17 and an elongated handle portion 18. If desired, the distal end portions of the handle portions 14 and 18 may be covered with a suitable handle grip 18*a*, which may be formed of a suitable plastic material, all in a known manner. The joint portions 13 and 17 of the levers 11 and 15 are overlapped and secured together for pivotal movement about the axis of a pivot member 19, which may be a screw, rivet, or other type of pivot structure.

Referring now also to FIGS. 2–6, the hand tool 10 is provided with a clip-on bias spring 20, constructed in accordance with and embodying the features of a first embodiment of the present invention. The bias spring 20 is of unitary, one-piece construction and includes an elongated mounting channel 21, which is generally C-shaped in transverse. cross section, but is formed of a plurality of flat panel sections. More specifically, the channel 21 includes a central, relatively wide, flat, panel section 22, the opposite side edges of which are joined at corners 23 to slightly upwardly inclined flat panel sections 24, the outer edges of which are joined at corners 25 to upwardly inclined panel sections 26 which terminate respectively in distal end edges 27. Each of the panel sections 22, 24 and 26 extends the length of the channel 21. The distal edges 27 are preferably substantially parallel and cooperate to define an opening into the channel. The maximum width of the channel 21 is at the corners 25 and, preferably, the distal edges 27 are spaced apart a distance less than this maximum width.

In use, the channel 21 is adapted to be clipped onto one of the handle portions 14 or 18 of the hand tool 10. In this regard, it will be appreciated that the bias spring 20 is of flexible and resilient construction and the panel sections 26 can be deflected slightly away from each other to permit the bias spring 20 to be clipped onto and resiliently grip the handle portion without the use of separate attachment structure, and preferably without the use of tools. It will be appreciated that the mounting channel 21 is configured to mate well with a particular handle cross section illustrated in FIG. 6, and that the mounting channel 21 would be provided with a different-shaped cross section to mate with different handle configurations.

The bias spring 20 also includes a bias leaf 30 which projects from one end of the-flat panel section 22. More specifically, the bias leaf 30 includes a bend 31 at the juncture with the panel section 22, an elongated inclined portion 32 which slopes out of the plane of the panel section 22, a relatively large-diameter curve 33 and arm inclined portion 34 which slopes back up toward the plane of the panel section 22 and is joined by a bend 35 to a tip or distal end portion 36, which is substantially at the plane of the panel section 22.

Referring in particular to FIGS. 1 and 2, in use the mounting channel 21 is clipped onto one of the handle portions 14 or 18 on the inner side thereof facing the other handle portion. If desired, where handle grips 18*a* are used, the associated handle grip may be formed over the mounting channel 21 to conceal it and assist in holding it in place. The bias spring 20 is positioned with the bias leaf 30 thereof projecting toward the pivot pin 19 and it is so dimensioned and configured as to engage the opposite handle portion in the vicinity of the bend 33, so as to bias the levers 11 and 15 apart to their open condition illustrated in the drawings. When thus mounted in place in its use position, the tip 36 of the bias spring 20 will engage the same handle portion to which the mounting channel 21 is clipped. This provides added support and stiffness and increases the effective spring force.

Referring to FIG. 7, there is illustrated an alternative form of the bias spring of the present invention, generally designated by the numeral 40. The bias spring 40 is substantially identical to the bias spring 20, described above, except that it includes an additional thickness or over layer 41 overlying the proximal end portion of the bias leaf, which becomes a base layer. This provides additional stiffness and increased spring force. Preferably, the extra thickness or over layer 41 may be laminated in place.

In FIG. 8, there is illustrated another embodiment 50 of the bias spring of the present invention, which is essentially the same as the bias spring 40, except that it includes two extra-thicknesses or over layers 51 and 52 which extend the entire length of the bias leaf 30. It will be appreciated that these multiple thicknesses or over layers could extend only a portion of the length of the bias leaf, as in FIG. 7. Also, the single extra thickness or over layer 41 of FIG. 7 could be extended along the entire length of the bias leaf.

Figure 9:
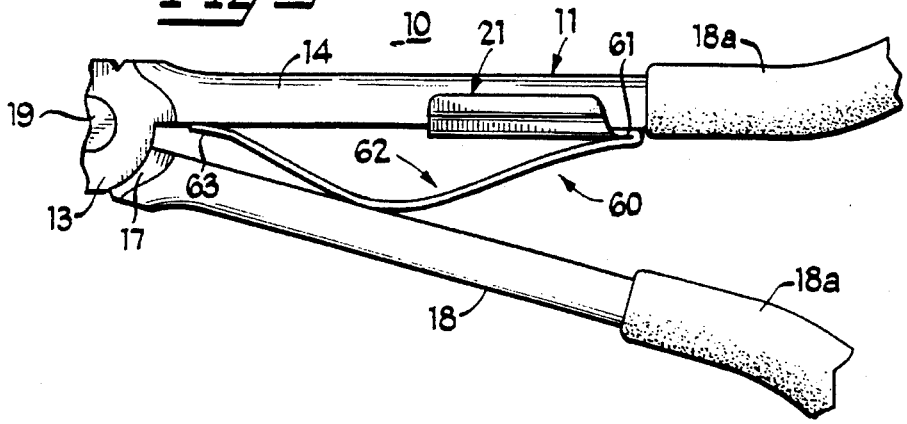
FIG. 9 is a fragmentary top plan view, similar to FIG. 1, illustrating the pliers incorporating a bias spring in accordance with another embodiment of the present invention.
Figure 10:
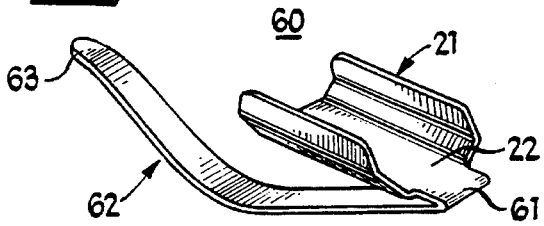
FIG. 10 is a perspective view of the clip-on bias spring of FIG. 9.

Referring to FIGS. 9 and 10, there is illustrated another embodiment 60 of the bias spring of the present invention. The spring 60 includes a mounting channel 21 substantially identical to that of the bias spring 20, described above. However, in this case, the flat panel section 22 extends a short distance beyond the end of the channel 21 to define a projecting tab 61. Unitary with the tab 61 at its distal end is a bias leaf 62, which depends from the tab 61 and extends back beneath the length of the channel 21 and beyond the forward end thereof, but is otherwise substantially identical in construction to the bias leaf 30 described above in connection with FIGS. 1–4. The bias leaf 62 terminates in a tip 63 which is disposed at rest substantially in the plane of the flat panel section 22 of the mounting channel 21. Thus, it will be appreciated that the overall length of the bias spring 60 is substantially reduced, so that it can fit between the hand tool joint portions 13 (or 17) of a lever and the handle grips 18*a* thereof, as can be seen in FIG. 9. The use and installation of the bias spring 60 is substantially identical to that for the bias spring 20, described above in connection with FIG. 1, except that because of its reduced length, the bias spring 60 can be retrofitted by a user on a pre-existing hand tool. When thus retrofitted, the bias spring 60 operates in substantially the same manner as the bias spring 20, described above.

Figure 11:
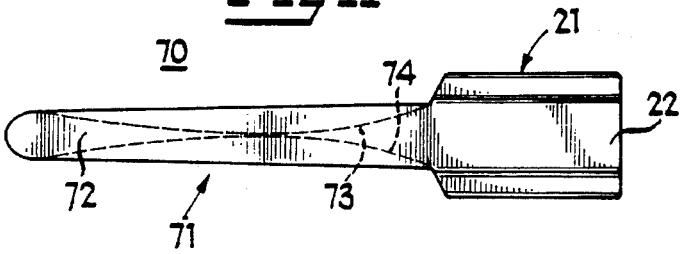
FIG. 11 is a bottom plan view of a clip-on bias spring in accordance with another embodiment of the invention.
Figure 12:
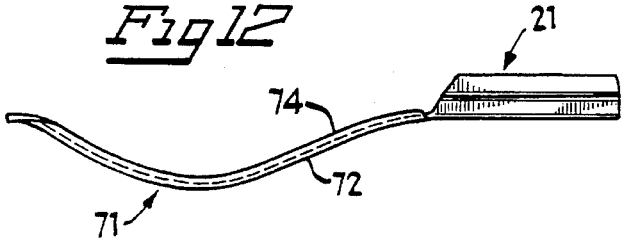
FIG. 12 is a side elevational view of the clip-on bias spring of FIG. 11.
Figure 13:
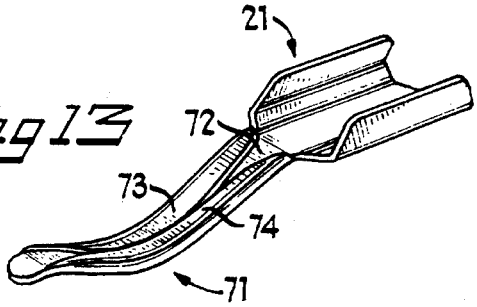
FIG. 13 is a perspective view of the clip-on bias spring of FIG. 11.

Referring now to FIGS. 11–13, there is illustrated a bias spring 70 in accordance with yet another embodiment of the present invention. The bias spring 70 includes a mounting channel 21 substantially identical to that of the bias spring 20 of FIG. 1, and a bias leaf 71 projecting therefrom which includes a base portion 72 which is substantially the same as the bias leaf 30 of the bias spring 20. However, in this case, the bias leaf 71 also includes lateral tabs 73 and 74 respectively unitary with the opposite side edges of the base portion 72 and which are folded thereover so as to provide a double thickness of material along most of the length of the bias leaf 71. This will afford additional stiffness and spring force, in the same manner as was described above in connection with the leaf springs 40 and 50 of FIGS. 7 and 8, but avoids lamination. It will be appreciated that the over layer could be formed by a single lateral tab having a width sufficient to span the entire width of the base portion 72.

From the foregoing, it can be seen that there has been provided an improved hand tool opening bias spring which can be clipped onto a tool handle without the use of additional tools or attachment structure and without requiring any alterations in the construction of the hand tool.

I claim:

1. A long-reach pliers comprising:

a pair of levers each having a jaw portion and a handle portion which includes an elongated straight neck portion and a grip portion; a joint coupling said levers between said neck and jaw portions for pivotal movement toward and away from each other between closed and open conditions; said grip portions being curved so that they are spaced apart further than said neck portions are spaced apart in all positions of said levers, and a flexible and resilient spring including a coupling channel and a bias leaf, said coupling channel having opposed ends and being generally C-shaped in transverse cross section and having a maximum width, said channel having free distal side edges cooperating to define an opening into said channel and being spaced apart a distance less than the maximum width of said channel, said channel including a plurality of substantially flat panel sections each extending from one end of said channel to the other end thereof and each defining a plane when at rest, said panel sections including a base panel section and a pair of side panel sections with the planes defined by said slide panel sections intersecting the plane defined by said base panel section, each of said side panel sections having one of said side edges disposed thereon and lying in the plane defined by the panel section on which the side edge is disposed, said channel being disposed in a use position receiving therein one of said levers adjacent to the junction between the neck and grip portions thereof, said bias leaf being unitary with one of said panel sections and projecting from one end of said channel, said leaf being curved out of the plane of said one panel section so that when said coupling channel is in its use position said bias leaf engages the neck portion of the other of said levers to bias said levers to the open condition while being yieldable to accommodate movement of said levers to their closed condition, said bias leaf terminating at a distal end portion releasably engageable with the neck portion of the one lever.

2. The pliers of claim 1, and further comprising a gripping sleeve disposed on said one lever and covering said channel.

* * * * *